United States Patent [19]

Izunaga et al.

[11] Patent Number: 4,889,471

[45] Date of Patent: Dec. 26, 1989

[54] MECHANISM FOR PREVENTION OF BURNING OF BEARING PORTIONS IN A HERMETIC TYPE SCROLL COMPRESSOR

[75] Inventors: Yasushi Izunaga; Hiroaki Kuno; Shintaro Sado, all of Shimizu, Japan

[73] Assignee: Hatachi, Ltd., Tokyo, Japan

[21] Appl. No.: 216,654

[22] Filed: Jul. 7, 1988

[30] Foreign Application Priority Data

Jul. 10, 1987 [JP] Japan ..... 62-170978

[51] Int. Cl.[4] ..... F04B 49/02; F04C 18/04

[52] U.S. Cl. ..... 417/32; 417/281; 418/55 E; 418/94; 184/108

[58] Field of Search ..... 417/228, 32, 372, 281, 417/13; 418/98, 55 E, 94, 97, 2; 184/6.4, 6.16, 6.18, 108

[56] References Cited

U.S. PATENT DOCUMENTS

| | | | |
|---|---|---|---|
| 1,863,851 | 6/1932 | Hughes | 417/32 |
| 3,232,519 | 2/1966 | Long | 417/32 |
| 3,233,822 | 2/1966 | Comstock et al. | 417/32 X |
| 4,343,599 | 8/1982 | Kousokabe | 418/55 E |
| 4,370,099 | 1/1983 | Gannaway | 417/32 |
| 4,648,814 | 3/1987 | Shiibayashi | 418/55 E |
| 4,676,075 | 6/1987 | Shiibayashi | 418/55 E |
| 4,735,559 | 4/1988 | Morishita et al. | 418/2 |

FOREIGN PATENT DOCUMENTS 61-112794 5/1986 Japan .

*Primary Examiner*—Carlton R. Croyle
*Assistant Examiner*—Leonard P. Walnoha
*Attorney, Agent, or Firm*—Antonelli, Terry & Wands

[57] ABSTRACT

In a scroll compressor, an open end of an oil extraction pipe which is placed in oil stored in a bottom portion of a hermetic casing is positioned at a location higher than an open end of an oil suction pipe that opens in the same stored oil, and a thermostat is provided for sensing a temperature rise of a compressed gas to cause the compressor to be stopped. Accordingly, even when an amount of oil injected into the compressed gas decreases, an amount of oil necessary for lubrication of a bearing portion is assured. The provision of the thermostat enables the compressor to be stopped before an amount of supply of the lubrication oil to the bearing portion has decreased. It is, accordingly, possible to positively prevent burning of the bearing portion of a crankshaft.

5 Claims, 3 Drawing Sheets

MECHANISM FOR PREVENTION OF BURNING OF BEARING PORTIONS IN A HERMETIC TYPE SCROLL COMPRESSOR

BACKGROUND OF THE INVENTION

The present invention relates to an oil injection type hermetic scroll compressor for use as an air compressor, a helium compressor or the like.

Some types of hermetic scroll compressors having hermetic casings maintained in a high-pressure condition incorporate so-called oil injection systems in which an oil is injected for the purpose of cooling a compressed gas. In disclosed in, for example, Japanese Patent Unexamined Publication No. 61-112794 or U.S. Pat. No. 4,648,814, an oil injection system is generally arranged to effect separation of the oil injected into the compressed gas within the hermetic casing and store the resultant oil in a bottom portion of the hermetic casing. The oil injection system includes an oil extraction pipe for allowing injection of the oil into the compressed gas, with and one open end of the oil extraction pipe being located in the oil stored in the bottom portion, and an oil suction pipe is provided for supplying the oil as lubricating oil to the bearings of the compressor, with and one open end of the oil suction pipe located in the same stored oil.

A greater portion of the oil contained in the compressed gas is subjected to separation within the hermetic casing, and is stored in the bottom portion. The non-separated portion of the oil is fed to a discharge pipe of the compressor together with a discharged gas, and is subjected to separation in an oil separator disposed at a midway point in the discharge pipe. The thus-separated oil is injected into a suction pipe of the compressor or a compression chamber at an intermediate point of its compression stroke, so that the amount of oil stored in the bottom portion of the hermetic casing is maintained at a fixed level.

However, 1 problem of the above-proposed system resides in the fact that, in the event that no sufficient separation is accomplished by the oil separator disposed midway in the compressor discharge pipe, a portion of the oil will be discharged together with the compressed gas from the outlet side of the oil separator. As a result, the amount of oil stored in the bottom portion of the hermetic casing gradually decreases with the passage of time and, therefore, the amount of supply of a lubricating oil to the bearings of the compressor will decrease thereby possibly leading to the burning of the bearings.

SUMMARY OF THE INVENTION

It is therefore an object of the present invention to provide a hermetic type scroll compressor having a simplified mechanism capable of positively preventing the burning of a bearing portion by stopping the operation of the compressor before the amount of supply of a lubricating oil to the bearing portion has decreased even if the amount of oil stored in the bottom portion of the hermetic casing decreases due to various causes such as insufficient separation in the oil separator disposed midway in the discharge pipe of the compressor.

In achieving the above and other objects, in accordance with the present invention, there is provided a simplified mechanism in which the open end of an oil extraction pipe which opens into the oil stored in the bottom portion of the hermetic casing is positioned at a location higher than the open end of an oil suction pipe that is placed in the same stored oil, and which includes a thermostat for sensing the temperature rise of a compressed gas to cause the compressor to be stopped.

In accordance with the present invention, if the amount of oil stored in the bottom portion of the hermetic casing decreases to a level corresponding to the position of the open end of the oil extraction pipe, the amount of oil injected into a compressed gas through the oil extraction pipe will decrease, but the amount of oil necessary for lubrication of the bearing portion is assured since the suction end of the oil suction pipe is located at a position lower than the open end of the oil extraction pipe. As the amount of injected oil in the compressed gas decreases, the temperature of the compressed gas increases gradually. The thermostat senses this temperature rise and operates to cause the compressor to be stopped. Since the open end of the oil extraction pipe is positioned at a location higher than the open end of the oil suction pipe in the bottom portion of the hermetic casing, the amount of supply of the lubricating oil to the bearing portion is prevented from decreasing even when the compressor is stopped.

As described above, the provision of the thermostat for sensing the temperature rise of the compressed gas enables the compressor to be stopped before the amount of supply of the oil into the bearing portion of a crankshaft has decreased, whereby it is possible to positively prevent the burning of the bearing portion of the crankshaft.

BRIEF DESCRIPTION OF THE DRAWINGS

A better understanding of the present invention may be gained from the following detailed description when read in connection with the accompanying drawings, in which.

Figure 1:
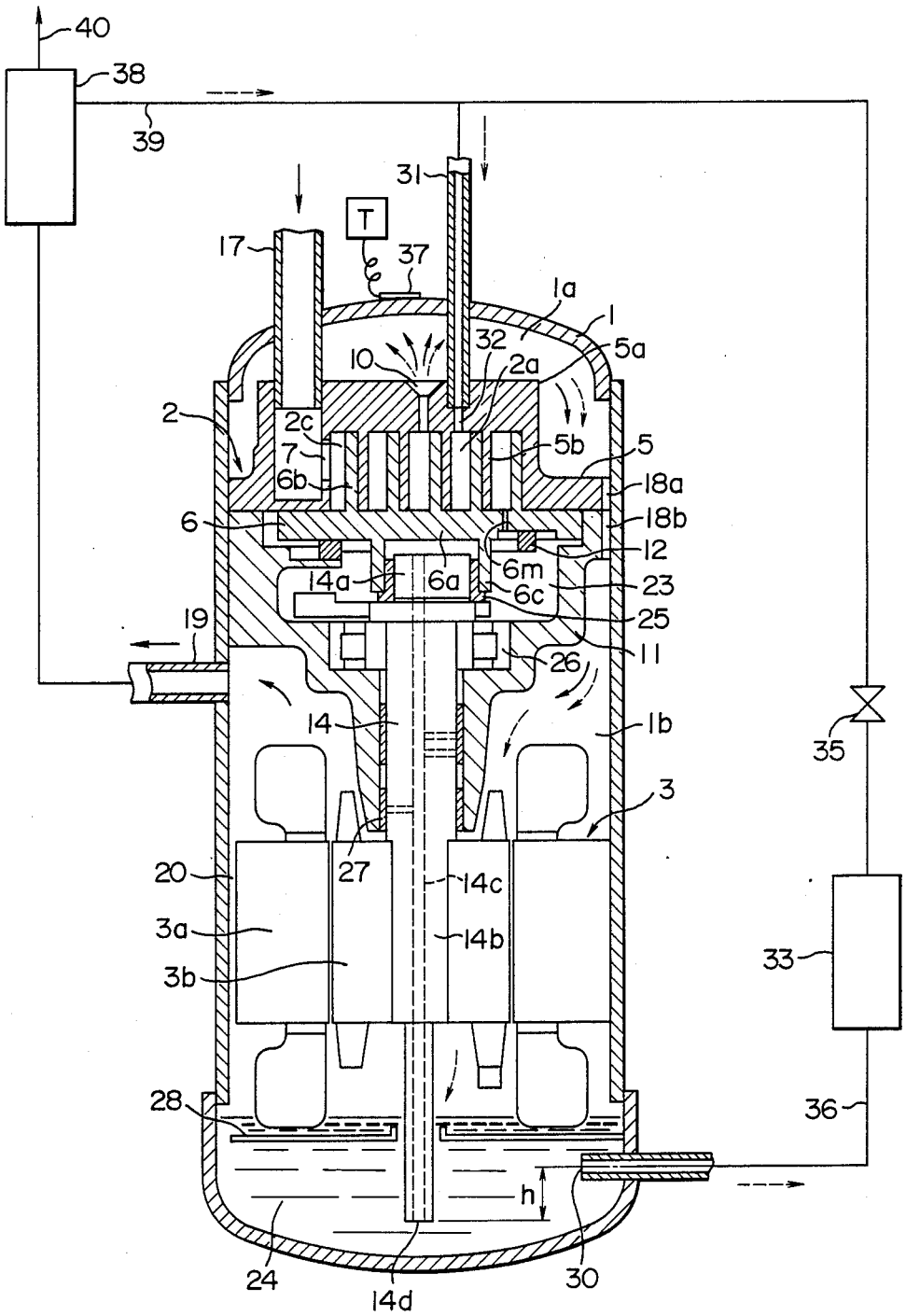
FIG. 1 is a vertical sectional view of one embodiment of a scroll compressor according to the present invention.

Referring now to the drawings wherein like reference numerals are used throughout the various views and, more particularly, to FIG. 1, according to this figure, a scroll compressor section generally designated by the reference numeral 2 is accommodated in an upper portion or chamber 1*a* of a hermetic casing 1, while an electric motor section generally designated by the reference numeral 3 is accommodated in a lower portion of the hermetic casing 1. The scroll compressor section 2 includes a compression chamber (hermetically enclosed space) which is formed by the engagement between a stationary scroll member 5 and an orbiting scroll member 6.

The stationary scroll member 5 includes a disk-shaped end plate 5*a* and a wrap 5*b*, of vortical form in volute or similar curve, located on the end plate 5*a* in upstanding position. The end plate 5*a* is provided with a discharge port 10 in its center and a suction port 7 in its outer circumferential portion. The orbiting scroll member 6 includes a disk-shaped end plate 6*a*, a wrap 6*b* located on the end plate 6*a* in upstanding position and having a shape similar to that of the end plate 5*b* of the stationary scroll member 5, and a boss 6*c* formed on the side of the end plate 6a opposite to the wrap 6b. A frame 11 has a bearing portion in its central portion, and a crankshaft 14 is journaled by the bearing portion. An eccentric shaft 14a, provided at the top end of the crankshaft 14, is inserted into the boss 6c so as to allow orbital movement of the orbital scroll member 6. The stationary scroll member 5 is fixed to the frame 11 by a plurality of bolts, and the orbiting scroll member 6 is movably supported on the frame 11 by an Oldham's mechanism 12 constituted by a Oldham's ring and an Oldham's key so that the orbiting scroll member 6 does not rotate about its axis but can make an orbital movement with respect to the stationary scroll member 5. The lower portion of the crankshaft 14 is integral with a motor shaft 14b to form direct coupling with the electric-motor section 3. A suction pipe 17 extending through the hermetic casing 11 in the vertical direction communicates with the suction port 7 of the stationary scroll member 5. The upper chamber 1a formed with a discharge port 10 communicates with the electric-motor chamber 1b through passageways 18a and 18b. The electric-motor chamber 1b communicates with a discharge pipe 19 which extends from the hermetic casing 1. The upper and lower portions of the electric-motor chamber 1b communicate with each other through a gap 20 between a stator 3a and the inner side wall of the hermetic casing 1 as well as the gap between the stator 3a and a rotor 3b.

A space 23 which is surrounded by the frame 11 (hereinafter referred to as a "backpressure chamber") is formed on the back side of the end plate 6a of the orbiting scroll member 6. A small bore 6m is axially formed in the end plate 6a of the orbiting scroll member 6, and an intermediate between a suction pressure and a discharge pressure is introduced into the backpressure chamber 23 through the axial small bore 6m, thereby generating an axial force which acts to press the orbiting scroll member 6 against the stationary scroll member 5.

A lubricating oil 24 is stored in a bottom portion of the hermetic casing 1, with the lubricating oil 24 being sucked axially upwardly through an oil suction pipe 14d by a differential pressure between the high pressure in the hermetic casing 1 and the intermediate pressure in the backpressure chamber 23. The lubricating oil 24 ascends in a suction bore 14c which axially extends through the crankshaft 14, and is supplied to an orbital bearing 25, a main bearing 26 and an auxiliary bearing 27. The lubricating oil 24 supplied to the respective bearings is then fed through the backpressure chamber 23 into the compression chamber defined between the stationary scroll member 5 and the orbiting scroll member 6, and is mixed with the compressed gas in the compression chamber. Then, the gas is discharged together with a discharged gas to the interior of the upper chamber 1a. An anti-homing plate 28 is disposed on the surface of the lubricating oil 24.

An oil extraction pipe 30 for extracting the lubricating oil 24 from the bottom portion of the hermetic casing 1 in the bottom portion at a location which is higher than the suction end of the oil suction pipe 14d by a distance h. The top of the hermetic casing 1 is formed with an oil injection pipe 31 for injecting the oil 24 into the compression chamber 2a of the scroll compressor section 2 at a midway point in its compression stroke. A port 32 is axially formed in the end plate 5a of the stationary scroll member 5, and the oil injection pipe 31 communicates with the compression chamber 2a through the port 32.

The oil extraction pipe 30 and the oil injection pipe 31 are connected by an oil pipe 36 which includes an oil cooler 33 and a throttling device 35.

A thermostat 37 is provided on the external wall of the upper chamber 1a of the hermetic casing 1 for sensing a temperature rise due to the gas discharged into the upper chamber 1a to cause the compressor to be stopped.

An oil separator 38 for effecting separation of the oil discharged together with the discharged gas is connected to the discharge pie 19, and an oil return pipe 39 and a delivery pipe 40 through both of which the thus-separated oil flows are connected to the oil separator 38.

When the crankshaft 14b, directly coupled to the rotor 3b, is rotated about its axis to cause the eccentric shaft 14a to rotate eccentrically, the orbiting scroll member 6 makes an orbital movement by means of the orbital bearing 25. This orbital motion causes the compression chamber 2a to move toward the center while progressively decreasing the volume thereof. In the meantime, a working gas is supplied from the suction pipe 17 through the suction port 7 into a suction chamber 2c and, at the same time, the oil which has lubricated the bearings flows into the suction chamber 2c through the gap between the stationary scroll member 5 and the orbiting scroll member 6 at the outer peripheral portion thereof. Thus, the oil is mixed with the working gas in the suction chamber 2c. The working gas containing the oil is compressed in the compression chamber, discharged through the discharge port 10 into the upper chamber 1a, and fed into the electric-motor chamber 1b through the passageways 18a and 18b. In FIG. 1, the arrows shown by solid lines indicate the flow of the working gas, while the arrows shown by dashed lines indicate the flow of the oil. When the working gas flows through the narrow passageway 18a and 18b into the electric-motor chamber 1b having an ample space, the velocity of the flowing gas abruptly decreases and the direction of the flow changes. Therefore, the substantial part of the oil contained in the working gas is separated therefrom and, after the separation, the working gas flows into the discharge pipe 19, while the separated oil flows down through the gap 20 formed between the stator 3a and the inner side wall of the hermetic casing 1 and is stored in the bottom portion of the hermetic casing 1. The oil 24 thus stored in the bottom portion of the hermetic casing 1 flows through the oil extraction pipe 30 into the oil pipe 36 owing to the differential pressure between the pressure in the hermetic casing 1 (discharge pressure) and the pressure in the compression chamber 2a (a pressure equal to or less than the discharge pressure). The oil 24, in turn, flows into the oil cooler 33. After being cooled to a suitable temperature, the oil 24 passes through the throttling device 35, the oil pipe 36 and the oil injection pipe 31, and is injected from the port 32 into the compression chamber 2a. The oil injected into the compression chamber 2a serves to cool the working gas therein and to lubricate individual sliding portions such as the end portions of the scroll wraps 5b and 6b. The oil together with the working gas is compressed and discharged through the discharge port 10 into the upper chamber 1a. Then, in the same manner as described above, the oil is separated from the working gas in the electric-motor chamber 1b and is stored in the bottom portion of the hermetic casing 1. Each of the bearings 25, 26 and 27 is lubricated through the oil suction pipe 14*d* and the suction bore 14*c* in the crankshaft 14*a* by virtue of the differential pressure between the pressure in the hermetic casing 1 and the pressure in the backpressure chamber 23 (the intermediate pressure).

As described above, the substantial portion of the oil contained in the working gas is separated therefrom in the hermetic casing 1 and is stored in the bottom portion thereof. However, a portion of the oil is not separated, and is discharged from the discharge pipe 19 together with the compressed gas. This oil is subjected to separation in the oil separator 38. The resultant oil enters the oil injection pipe 31 through the oil return pipe 39, and is then injected into the compression chamber 2*a* together with the oil which has been extracted from the bottom portion of the hermetic casing 1 through the oil extraction pipe 30. The compressed gas which has been separated from the oil is discharged through the delivery pipe 40 of the oil separator 38.

If no satisfactory oil separation is obtained in the oil separator 38, the compressed gas containing a certain amount of oil is discharged from the delivery pipe 40, resulting in the oil 24 stored in the bottom portion of the hermetic casing 1 decreasing with the passage of time. Subsequently, when the oil 24 decreases to the level corresponding to the lower end of the oil extraction pipe 30, the amount of oil extracted through the oil extraction pipe 30 and injected from the oil injection pipe 31 into the compression chamber 2*a* decreases. However, since the lower end of the oil suction pipe 14*d* opens at a location which is lower than the open end of the oil extraction pipe 30 by the distance h, the oil sucked up through the oil suction pipe 14*d* is continuously supplied to each of the bearings. If no oil is injected into the compression chamber 2*a*, the temperature of the compressed gas discharged into the upper chamber 1*a* rises gradually. The thermostat 37 senses this temperature rise and operates to cause the compressor to be stopped. The position of the open end of the oil extraction pipe 30 is, as described previously, selected to be higher than the position of the lower end of the oil suction pipe 14*d* by the height h. Therefore, even when the oil 24 decreases to the level corresponding to the position of the open end of the oil extraction pipe 30, the amount of supply of the lubricating oil 24 through the oil suction pipe 14*d* to the respective bearings 25, 26 and 27 does not decrease, and it is therefore possible to positively prevent the burning of the bearings 25, 26 and 27.

Figure 2:
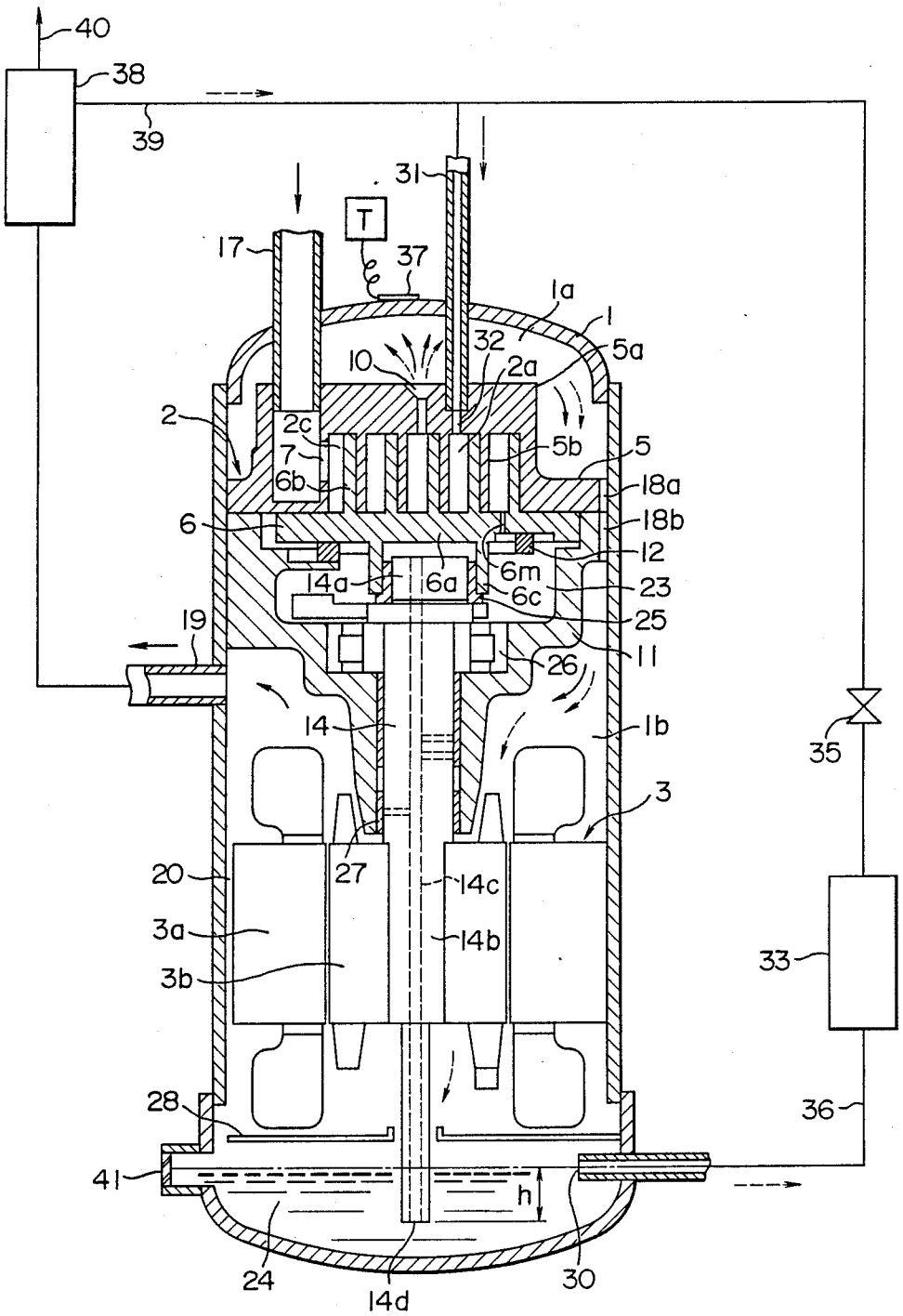
FIG. 2 is a vertical sectional view of another embodiment of the scroll compressor according to the present invention, and illustrates its oil supply line in diagram form.

FIG. 2 shows an embodiment which differs from the embodiment of FIG. 1 in that a sight glass 41 is provided at the bottom portion of the hermetic casing 1 so as to allow visual confirmation of the level or surface of the oil 24 which is near the position of the open end of the oil extraction pipe 30.

FIG. 2 shows a state wherein the oil 24 stored in the bottom portion of the hermetic casing 1 decreases to the level that corresponds to the position of the open end of the oil extraction pipe 30. In this state, the amount of oil injected from the oil injection pipe 31 into the compression chamber 2*a* through the oil extraction pipe 30 decreases, and the temperature of the compressed gas discharged into the upper chamber 1*a* rises. This temperature rise causes the thermostat 37 to be operated, thereby causing the compressor to be stopped. As illustrated, the position of the open end of the oil extraction pipe 30 is higher than the position of the lower end of the oil suction pipe 14*d* by the height h. Therefore, even when the oil 24 decreases to the level corresponding to the position of the open end of the oil extraction pipe 30, the amount of lubricating oil supplied through the oil suction pipe 14*d* to the respective bearings 25, 26 and 27 does not decrease, and it is therefore possible to positively prevent the burning of the bearings 25, 26 and 27, as in the case of the embodiment of FIG. 1.

With the embodiment shown in FIG. 2, it is possible to visually check, directly through the sight glass 41, whether or not the oil 24 has decreased to the level corresponding to the position of the open end of the oil extraction pipe 30. Therefore, even if the oil 24 decreases to cause the thermostat 37 to operate, thereby causing the compressor to be stopped, it is possible to prevent the burning of the bearings. In addition, an operator can rapidly determine whether or not an additional supply of oil is needed since it is possible to visually check, directly through the sight glass 41, whether or not the oil 24 has decreased to the level corresponding to the position of the open end of the oil extraction pipe 30. This advantage provides the effect of enabling rapid re-starting of the normal operation of the compressor only by charging an additional supply of oil after the confirmation of an decrease in the oil 24 in the bottom portion of the hermetic casing 1.

Figure 3:
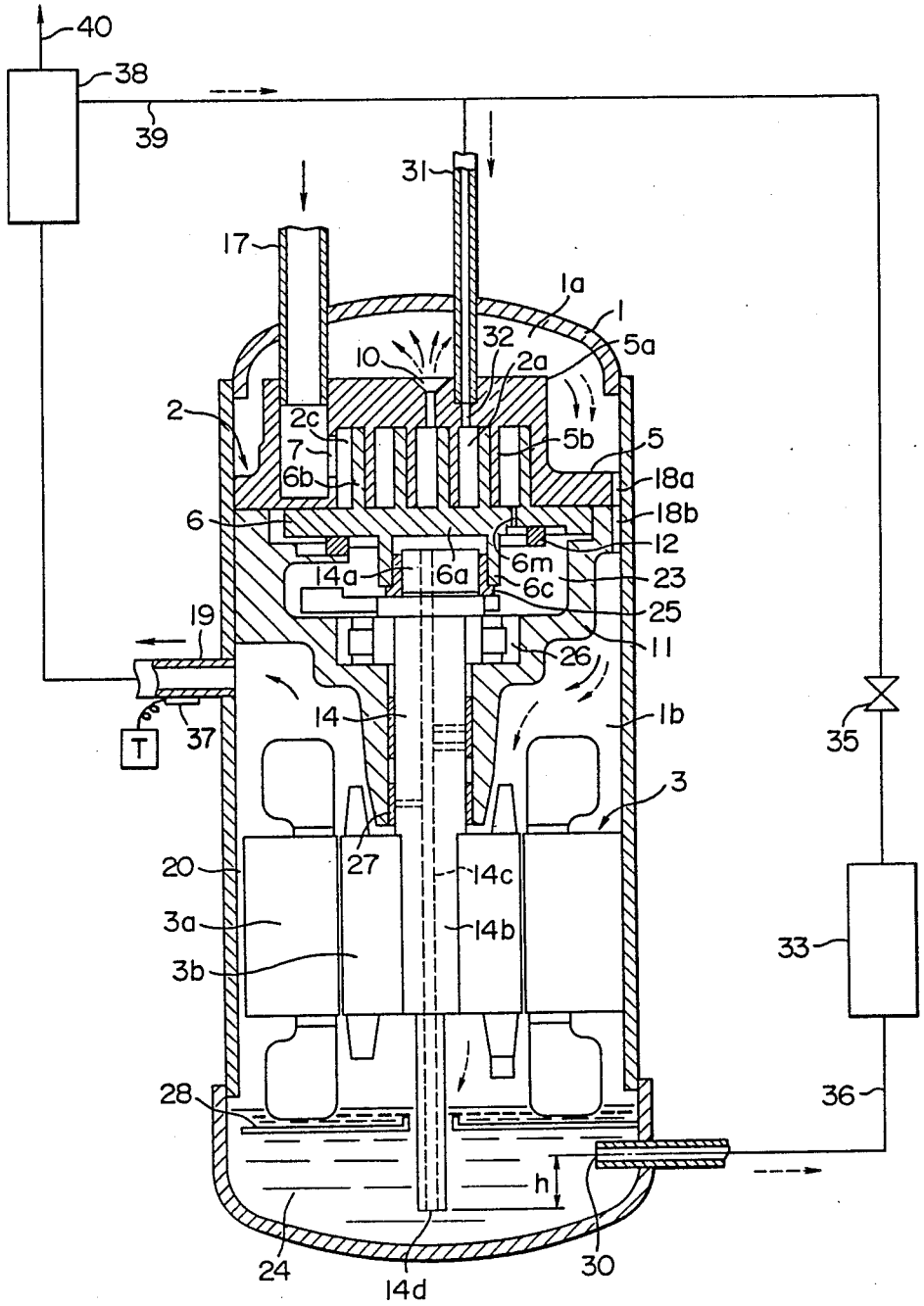
FIG. 3 is a view of yet another embodiment of a scroll compressor according to the present invention.

In either of the above-described embodiments, the thermostat 37 for sensing a rise in the temperature of the compressed gas to cause the compressor to be stopped is installed on the outer wall of the hermetic casing 1. However, as shown in FIG. 3 the thermostat 37 can also be installed on the outer wall of the discharge pipe 19 or any other portion that would allow proper sensing of variations in the temperature of the compressed gas. This arrangement can also achieve effects similar to the above-described ones.

The above description of the above-described embodiments refers to the effects achieved in the case where the oil 24 is injected into the compression chamber 2*a*. However, in another case where the oil 24 is injected into the suction pipe 17, the present invention can achieve effects similar to the above-described ones.

In all of the above-described embodiments, the oil extraction pipe has an open end which is located in a vicinity of a level corresponding to a lower limit level of the set amount of oil to be stored in the oil storage portion of the hermetic type scroll compressor.

Although the above description of of the 3 embodiments refers to the effects achieved in the case where the oil 24 is injected into the compression chamber 2*a* through a single oil injection pipe 31. However, in another case where the oil 24 is injected into the compression chamber 2*a* through a plurality of oil injection pipes, the present invention can achieve similar effects.

What is claimed is:

1. A hermetic type scroll compressor comprising a hermetic casing;

a scroll compressor section;

an electric motor section;

a crank shaft rotatably supported by a frame means and disposed along a vertical axis of said scroll compressor, said scroll compressor section and said electric motor section being coupled to each other by said crank shaft;

an oil suction bore means extending through said crank shaft for supplying oil to bearing means of the compressor section of the scroll compressor;

an oil suction pipe means connected at a first end thereof to a bottom end of said crank shaft for axially extending said oil suction bore means, said oil suction pipe means having a second end opening into the oil stored in an oil storage portion provided at a bottom portion of said hermetic casing;

an oil extraction pipe means opening at a first end into the oil stored in said oil storage portion so as to allow extraction of said oil from said oil storage portion and supplying the extracted oil through an oil cooler means and throttling means to an oil injection pipe means for injecting the extracted oil into one of a suction chamber means or a compression chamber means of the compressor section at a midpoint of a compression stroke of the scroll type compressor;

the hermetic type scroll compressor compresses a gas in said scroll compressor section, discharges said gas into said hermetic casing to effect separation of the oil contained in said gas in said hermetic casing, discharges said gas from said hermetic casing after separation while storing separated oil in said oil storage portion; wherein said second end of said oil suction pipe means is located near the bottom of said oil storage portion, said first end of said oil extraction pipe means is positioned higher than the position of said second end of said oil suction pipe means in said oil storage portion so that as a level of the oil in the oil storage portion falls below the first end of the oil extraction pipe means the supply of oil to the oil injection pipe means is interrupted whereby a temperature of the compressed discharged gas increases due to the decrease in the amount of oil injected by the oil injection pipe means; and wherein a thermostat means is provided on a portion of an outside wall means for defining a space of said hermetic casing into which said gas is discharged for sensing the increase in temperature of said discharged gas to cause said hermetic type scroll compressor to be stopped upon the temperature reaching a predetermined level due to the decrease in the amount of oil injected by the injector pipe means into one of a suction chamber means of said scroll compressor or a compression chamber means of said scroll compressor section.

2. A hermetic type scroll compressor according to claim 1, wherein said portion of the outside wall means is a top portion of said hermetic casing.

3. A hermetic type scroll compressor according to claim 1, wherein said portion of the outside wall means is a discharge pipe portion of said hermetic casing.

4. A hermetic type scroll compressor according to claim 1, wherein said first end of said oil extraction pipe is located in a vicinity of a level corresponding to a lower limit level of a set amount of oil to be stored in said oil storage portion.

5. A hermetic type scroll compressor according to claim 1, further including a sight glass means provided at the bottom portion of said hermetic casing for allowing a visual check of the level of oil in a vicinity of the first end of said oil extraction pipe means.

* * * * *